US007877942B2

(12) United States Patent
Tochev et al.

(10) Patent No.: US 7,877,942 B2
(45) Date of Patent: Feb. 1, 2011

(54) DEVICE FOR CONTROLLING THE ATMOSPHERE IN A SPACE

(76) Inventors: Ivan Tochev, Mariahilfer Strasse 118/1/33, A-1070 Wien (AT); Dimitre Tochev, Mariahilfer Strasse 118/1/33, A-1070 Wien (AT)

( * ) Notice: Subject to any disclaimer, the term of this patent is extended or adjusted under 35 U.S.C. 154(b) by 993 days.

(21) Appl. No.: 11/579,872

(22) PCT Filed: May 11, 2005

(86) PCT No.: PCT/AT2005/000158

§ 371 (c)(1),
(2), (4) Date: Nov. 8, 2006

(87) PCT Pub. No.: WO2005/108729

PCT Pub. Date: Nov. 17, 2005

(65) Prior Publication Data

US 2007/0188094 A1 Aug. 16, 2007

(30) Foreign Application Priority Data

May 12, 2004 (AT) ..... A 822/2004

(51) Int. Cl.
*E04C 5/08* (2006.01)

(52) U.S. Cl. ..... 52/223.2; 52/1; 52/173.1; 52/656.5

(58) Field of Classification Search ..... 52/1, 52/173.1, 172, 223.2, 204.593, 656.5
See application file for complete search history.

(56) References Cited

U.S. PATENT DOCUMENTS 2,062,747 A * 12/1936 Gelstharp ..... 52/172
3,604,163 A 9/1971 McCurdy et al.
3,803,784 A * 4/1974 Becker ..... 52/405.3
3,810,331 A * 5/1974 McCurdy et al. ..... 49/401
3,811,239 A * 5/1974 Becker ..... 52/406.1
3,991,531 A * 11/1976 Becker ..... 52/405.3
4,306,387 A * 12/1981 Hopkins et al. ..... 52/1
4,397,121 A * 8/1983 Dunsmore ..... 52/1
4,459,789 A * 7/1984 Ford ..... 52/656.5
4,669,241 A * 6/1987 Kelly ..... 52/204.597

(Continued)

FOREIGN PATENT DOCUMENTS

DE 3345642 6/1985

(Continued)

*Primary Examiner*—Richard E Chilcot, Jr.
*Assistant Examiner*—Chi Nguyen
(74) *Attorney, Agent, or Firm*—Birch, Stewart, Kolasch & Birch, LLP

(57) ABSTRACT

A device for controlling the atmosphere in a space (16) which is partly delimited by at least one glass component (12, 13; 61) and which is separated from the environment (17, 18), with at least one connection between the space and the environment, and with at least one electrically actuatable valve (32, 33; 47, 48) associated with the connection, which valve is connected to an electric control unit (24); the valve (32, 33; 47, 48) is arranged in a connecting passage (34) within a member (15A) delimiting the space (16), namely in the case of an insulating glass assembly (11), a connecting ledge (15) arranged between two glass panes (12, 13) or, in the case of a lamp (60), in a socket (64), and the control unit (24) provided for an automatic actuation of the valve is also arranged in said member (15A).

20 Claims, 6 Drawing Sheets

U.S. PATENT DOCUMENTS

| | | | | |
|---|---|---|---|---|
| 4,822,649 | A * | 4/1989 | Canaud et al. | 428/34 |
| 5,587,828 | A * | 12/1996 | Bernard, Jr. | 359/275 |
| 5,980,074 | A | 11/1999 | Hwang et al. | |
| 6,252,648 | B1 | 6/2001 | Hase et al. | |

FOREIGN PATENT DOCUMENTS

| | | | |
|---|---|---|---|
| DE | 3428726 | | 2/1986 |
| DE | 3728726 | | 3/1989 |
| DE | 38 44 639 | A1 | 6/1990 |
| DE | 19823081 | | 11/1999 |
| DE | 10141897 | | 4/2003 |

* cited by examiner

DEVICE FOR CONTROLLING THE ATMOSPHERE IN A SPACE

The invention relates to a device for controlling the atmosphere in a space which is partly delimited by at least one glass component and which is separated from the environment, including at least one connection between the space and the environment, and including at least one electrically actuatable valve associated with the connection, which valve is connected to an electric control unit.

Further, the invention relates to an insulating glass assembly as well as to a lamp which includes such a device.

With an insulating glass assembly, also called insulating glass, multilayer glass or glass panel, it is known (compare e.g. DE 38 44 639 A1) to compensate pressure differences between the environment and the interspace between the glass panes of the insulating glass assembly or to keep the pressure within predetermined thresholds so that no excessive load is exerted on the glass panes and the adhesive sites via which the glass panes are connected with spacer ledges provided on the edge. Especially with large-area insulating glass assemblies used for large windows or also in facade construction, for glass facades, considerable deformation of the glass panes occur due to pressure differences, which glass panes then curve outward when the pressure in the interspace between the glass panes is higher than the ambient pressure, or curve inward when, vice versa, the ambient pressure is higher than the pressure in the interspace. As proven in practice, the curves or tensions, respectively, are the larger, the greater the distance between the glass panes. These deformations may lead to breakage of glass or also to leakages in the system. This way, moisture from the environment may penetrate into the space delimited by the glass panes, possibly leading to a condensation of water vapor and, thus, to cloudiness. Another problem results from moisture penetration when elements, such as window blinds, blades, are provided between the glass panes or when coatings, e.g. metal vapor coatings (compare, e.g., DE 101 41 879 C1), are provided on the inner surface of the glass pane, since this then, due to the moisture, leads to negative effects, especially corrosion effects. Moreover, in the case of sun-screen blades or light-deflecting components being provided in the interspace between the glass panes, deformations of the glass panes may also result in friction between said elements and the inner sides of the glass panes when these elements are pivoted, if said glass panes are curved inward due to a lower internal pressure, whereby, on the one hand, said elements and, on the other hand, possible coatings provided on the inner side of the glass panes are mechanically negatively affected.

A further problem is that, due to the strong deformation occurring with larger distances between the glass panes, the distances between the glass panes optimally chosen for sound insulation and thermal insulation cannot be kept so that, apart from the disadvantageous increased moisture in the interspace between the glass panes, also the insulating values will be worse due to the no longer optimal distances.

In a comparable manner, the above disadvantages also result in case of other applications in which a controlled atmosphere in a space partly delimited by a glass component is of significance, such as, e.g., with lamps, especially with outdoor lamps, but also with vehicle lamps, where a transparent or translucent glass cover is attached to a housing in a leakproof manner, and where a light source, such as, e.g., an incandescent lamp or a fluorescent lamp, is attached to a base in an interior space, wherein inter alia connections and voltage supplying parts of the light source are negetively affected by moisture penetrating into the space. With such lamps, alternating heating and cooling, e.g., when turning the lamps on or off, respectively, continuously causes pressure differences, leading to moisture penetration, since a really gas-proof implementation of the housings with the glass covers is seldom feasible. Furthermore, oxidation of reflector surfaces occurs, thus making the lamps "blind".

It shall be mentioned here that by "glass components" not only glass components such as, e.g., glass panes made of silica glass and the like, are to be understood but also components made of transparent plastics, such as acrylic glass.

From DE 198 23 081 A1, a technique for producing insulating glass assemblies is known, wherein it is provided for the air to be sucked from the interspace between the glass panes by means of a mechanical valve in the manner of an "inverted" bicycle valve, by the aid of sucking pumps, on the one hand, and wherein it has also been proposed—similar as in DE 38 44 639 A1—to provide a stock of hydroscopic material, that means of a drying agent, in the interspace between the glass panes, on the other hand. With this technique, it is disadvantageous that after a certain time the drying agent is saturated with moisture and cannot absorb any moisture any longer and that for sucking off air the complicated connection of external sucking pumps is required. With this technique, it is thus very difficult to realize an adequate control of the atmosphere of the space between the glass panes with respect to an appropriate pressure comparable with the ambient pressure and a low moisture.

From DE 33 45 642 A1 it is known to provide a drying agent in a container which is connected with the interspace between the glass panes of an insulating glazing via a duct, wherein a connecting site is provided in the duct for removing the container with the drying agent when the latter is saturated and for exchanging it with a new container including the drying agent. Apart from the possible pressure differences, it is here disadvantageous that the respective state of the drying agent has to be visually monitored and that the drying agent has to be exchanged and that, moreover, no quick absorbance of the moisture in the atmosphere of the interspace between the glass panes by the drying agent is ensured either, since the container including the drying agent is connected with the interspace via a duct, wherein no continuous air circulation is provided.

According to the already mentioned DE 38 44 639 A 1 the pressure-compensating apparatus disclosed therein comprises a valve device in a duct between a control means and the controlled space, wherein the control means activates the valve device such that no pressure-compensating open connection is established between the interspace between the glass panes and the environment when short pressure impacts occur, e.g. when doors are banged. The valve device and the control means are provided outside the insulating glass assembly, and, in particular, several insulating glass members should be controlled by one single control means via separate pressure-compensating lines and valve devices provided therein. This is, however, disadvantageous with respect to the separate installation of the control means, the valve device and of the separate lines.

In DE 34 28 726 A1 there is also described an apparatus for keeping dry an air interspace between multiple glass members. Externally of said multiple glass members a relatively complicated valve device including a valve body which is expandable when being heated is provided, which body, in the cold state, keeps clear a passage from the air interspace to the environment via a drying-agent area, and, when being heated, closes said passage so that in this phase the drying agent may be regenerated by heating. Thus, in the normal state, the air interspace of the respective multiple glass members is in constant connection with the environment so that a continuous pressure compensation may occur, wherein, however, also moisture may continuously penetrate into the system and has to be absorbed by the drying agent. Apart therefrom, there is also provided a separate external installation of the drying agent compartment as well as of the valve device with a connecting duct to the air interspace of the multiple glass elements, ultimately leading to a separate apparatus, e.g. arranged on a wall adjoining the multiple glass elements. The heating procedure for opening the valve and regenerating the drying agent is initiated by means of a switch which is obviously to be actuated manually.

Finally, from U.S. Pat. No. 3,604,163 A, a pressure-compensating system for pane units is known, wherein several insulating glass elements are connected with the environment via a duct as well as, alternatively, via drying-agent areas which may be applied by the aid of valves. To alternatively include the drying-agent areas in the system, the valves are switched at predetermined times by the aid of a cam switch. Thus, also with this pressure-compensating device a complicated apparatus externally of the insulating glass elements is necessary.

It is now an object of the invention to propose a device as initially defined to eliminate at least most of the above-mentioned disadvantages and to render possible an adequate control of the atmosphere in the space to be controlled in a structurally simple manner so that a pressure, temperature and moisture compensation and a keeping dry of the atmosphere in the space to be controlled can be attained to avoid condensation and deterioration of the insulating values, respectively.

To achieve the object, the invention provides a device for controlling the atmosphere in a space (16) which is partly delimited by at least one glass component (12, 13; 61) and which is separated from the environment (17, 18), with at least one connection between the space and the environment, and with at least one electrically actuatable valve (32, 33; 47, 48) associated with the connection, which valve is connected to an electric control unit (24), characterized in that the valve (32, 33; 47, 48) is arranged in a connecting passage (34) within a member (15A) delimiting the space (16), namely, in the case of an insulating glass assembly (11), a connecting ledge (15) arranged between two glass panes (12, 13) or, in the case of a lamp (60), in a socket (64), and in that the electric control unit (24) provided for an automatic actuation of the valve is also arranged in said member (15A). Advantageous embodiments and further developments are indicated in the description below.

With the present technique an automatic actuation of a valve is achieved by means of an "integrated" electric control unit, the valve being arranged directly in the connection passage between the space and the environment, e.g. to compensate for the pressure difference between the space and the environment, optionally also to purge comparably humid air in the space and to drain off the same into the environment as well as to introduce dry air from the environment into the space. In this context, it has to be taken into consideration that with conventional insulating glass assemblies, especially for windows and for facades, but also in the case of partition elements, today often sun-screen blades, light-deflecting elements or the like are installed in the interspace between the glass panes, which elements are actuated electrically, optionally by a control means depending on the incident light so that a power connection is already present. Accordingly, in these cases, the intregrated electric control unit causes hardly any additional effort in terms of power supply. Also with free-standing lamps, especially outdoor lamps, e.g. wall lamps being exposed to ambient conditions, a supply with electric power is naturally already present so that also there no special additional measures have to be taken for establishing the power supply of the integrated control unit and of the electrically actuatable valve.

An advantage is also that it becomes possible to create insulating glass assemblies with a great distance between the glass panes, whereby again components requiring more space can be integrated into this interspace, apart from the fact that correspondingly great distances of the glass panes also allow especially good thermal and acoustic insulating values. A great distance enables the integration of especially broad and stabile blades or of roller blinds in the interspace. If especially broad and hard blades may be used, again greater blade lengths are rendered possible, without separate reinforcements or supports being necessary at intermediate positions for the blades. As mentioned, improved insulating values may be achieved through the larger distance (especially 25 mm and more) between the glass panes, wherein the distance may not exceed a certain limit to avoid convection in the interspace. In the case of sun-screen blades in the interspace such a convection of the gas content or the air content is additionally impeded. Tests have shown that the optimal distance for the best thermal insulating values is between about 40 mm and 60 mm. With such distances, also the integration of the control unit and of the valve in a connecting ledge can be realized very easily as then the connecting ledge is of a corresponding thickness.

Apart from the possible automatic pressure compensation, with the present technique moisture can be drained off continuously and actively from the space. Thus, a maintenance-free and timely unlimited use of, e.g. the insulating glass assemblies or the lamps, is enabled, wherein moisture condensation and corrosion effects (on metal vapor coatings of the glass or on the integrated elements such as blades) can be avoided.

In the case of the inventive control equipment, comparatively thin glass panes can advantageously be used with insulating glass assemblies, since the pressure differences between the interspace and the environment can be avoided or kept extremely small, and due to the good insulating values, insulating glass assemblies including two instead of three glass panes can be realized without any problems; thus leading to a substantial reduction in material costs as well as to an easier handling of the glass panes and the insulating glass assemblies, respectively. Moreover, the quality requirements on the adhesive connections of the glass panes in the region of the spacer ledges or frame legdes do not have to be that strict since hardly any pressure differences occur in use, and an absolute gasproofness is no longer necessary. Thus, even simple gaskets provided in the region of simple non-positive connections, such as clamp connections or screw connections, may suffice to achieve adequate impermeability, i.e. gluing is no longer necessary. This does not only mean that one step during production can be omitted but also that dismounting and repair work, such as, e.g., exchanging a glass pane, and also renewing of gaskets is facilitated, whereas such repair works have partly not been possible at all up to now.

In an especially simple embodiment of the inventive device, the control unit can automatically close and open, respectively, the at least one valve at predetermined intervals, wherein for this purpose said unit may include a timer or an (electronic) clock, respectively. The intervals may be created especially by a clock-pulse generator as timer. In this context, it is possible to open the valve at intervals of several minutes to ensure a pressure compensation, and to close the same thereafter, wherein it has to be considered that the pressure difference is not established suddenly but very slowly, e.g. in the course of one day. In the case that a drying agent is provided in the connecting passage, it is moreover conceivable to keep open the at least one valve and to close the same seldom, e.g. only once or twice a day, namely when the drying agent, e.g. a silica gel, shall be caused to emit the moisture which has been absorbed before to the environment by means of heating.

Another advantageous possibility is that the control unit actuates the at least one valve depending on the measured parameters, such as internal and external pressure and pressure difference, respectively, internal and external temperature as well as moisture. This way, the at least one valve may be opened when the difference between the internal and the ambient pressure reaches a predetermined threshold, wherein this may be achieved by measuring the pressure in the space as well as in the environment but also by directly measuring the pressure difference. To keep the moisture content in the space to be controlled low, in the case of an air exchange with the environment, it may deliberately be provided to introduce cold air from the environment into the space to be controlled, since cold air has a lower moisture content than warm air. For this purpose, the valve may be actuated depending on a temperature detection. In the case of an insulating glass assembly an external temperature sensor and an internal (building room) temperature sensor may also be provided to measure the colder "environment". Finally, also the moisture present in the space to be controlled and the ambient moisture, respectively, may be detected by means of sensors and, depending thereon, the valve may be opened and closed again by the control unit. Also here, external and internal sensors measuring the ambient moisture may be provided in the case of insulating glass assemblies used for windows and facades.

The sensors, which are intended to detect the ambient parameters, may simply be attached to the respective frame of the window or of the facade facing together with the insulating glass assembly, or, in the case of an outer lamp or the like, they may be attached on the exterior of the lamp's housing.

In the case of an insulating glass assembly it is, furthermore, also suitable to provide the connecting passage with a branching to which the branch ducts are connected leading to the outer side and the inner side of the insulating glass assembly, wherein an electrically actuatable valve connected to the control unit is arranged in each branch duct. It is thereby rendered possible to supply air from the respective colder environment (on the outer side or inner side) into the interspace between the glass panes. In a comparable manner, when moisture is detected, air may also be supplied to the interspace between the glass panes from that environment where the drier air is present.

In the connecting passage, i.e. in the part delimiting the space, an area receiving a drying agent may also be directly provided, wherein a conventional silica gel is preferably used as drying agent. Such a drying agent absorbs moisture from the space to be controlled until saturation has been achieved. In some environments, moisture which has been absorbed by the drying agent may repeatedly be released if the ambient temperature is temporarily high enough and if the drying agent is freely accessible towards the environment. In the vapor state, water has roughly the thousandfold volume of its volume in the bound or liquid state, allowing released vapors to escape outwards. Mostly, however, due to the ambient conditions, such a release of water in the form of vapor from the drying agent is not possible in a sufficient manner and, consequently, an electrical heating means is preferably assigned to the drying-agent area, which heating means is connected to the control unit and which is activated by the control unit, e.g. simply at fixed predetermined times. In doing so, however, the connection between the drying-agent area and the space to be controlled has to be interrupted in order to avoid water vapors escaping into the space and, accordingly, the electrically actuated valve which is activated by the control unit is provided between the space and the drying-agent area. Preferably, a valve is provided also on the other side of the drying-agent area, i.e. between the latter and the environment, to close the connection to the environment during normal operation and to make the drying agent freely accessible towards the space to be controlled via the then opened other valve.

As heating means, a simple electrical resistance heating, e.g. with a heating wire or a ceramic heating element, may be provided or, preferably, also a Peltier element. With such a Peltier element the drying agent may not only be heated but also cooled to readily prepare it for again absorbing moisture from the space to be controlled. Moreover, if the drying agent is cooled, moisture from the space to be controlled may be bound to the drying agent more readily.

When the power supply is interrupted or when other malfunctions with respect to the control means occur, a conventual pressure difference valve known per se, i.e. a simple mechanical valve, may be arranged as emergency valve in the member delimiting the space in a separate connecting passage between the space to be controlled and the environment, which valve opens in the case of a preset pressure difference (positive and negative, i.e. in both directions) and effects a pressure compensation between the space and the environment. The pressure difference at which said emergency valve becomes active is to be selected higher than the pressure difference at which the control unit usually activates the one or more valve(s) for pressure compensation, if a control means that is dependent on the pressure difference between the space and the environment is provided.

In the case of glass panels or insulating glass assemblies, respectively, the control unit including the valve(s) and the drying-agent area is arranged in a space-saving manner in the region of the frame ledges or the spacer ledges, and in the case of lamps, it is arranged in the socket of the lamps.

The invention, in an advantageous manner, also provides for an insulating glass assembly with a device according to the invention, wherein the space to be controlled is the interspace between the two spaced-apart glass panes; correspondingly, the invention also provides for a lamp, in particular an outdoor lamp, with a device according to the invention, wherein here the space to be controlled is a space of the lamp which is arranged behind a glass cover and which receives a light source.

In the following, the invention will be further explained by way of the drawing and with reference to preferred exemplary embodiments. In the drawing, in detail, FIG. 1 shows a schematic cross-section through an insulating glass assembly according to the prior art, wherein possible deformations of the glass panes are schematically illustrated in dashed lines;

Figure 5:
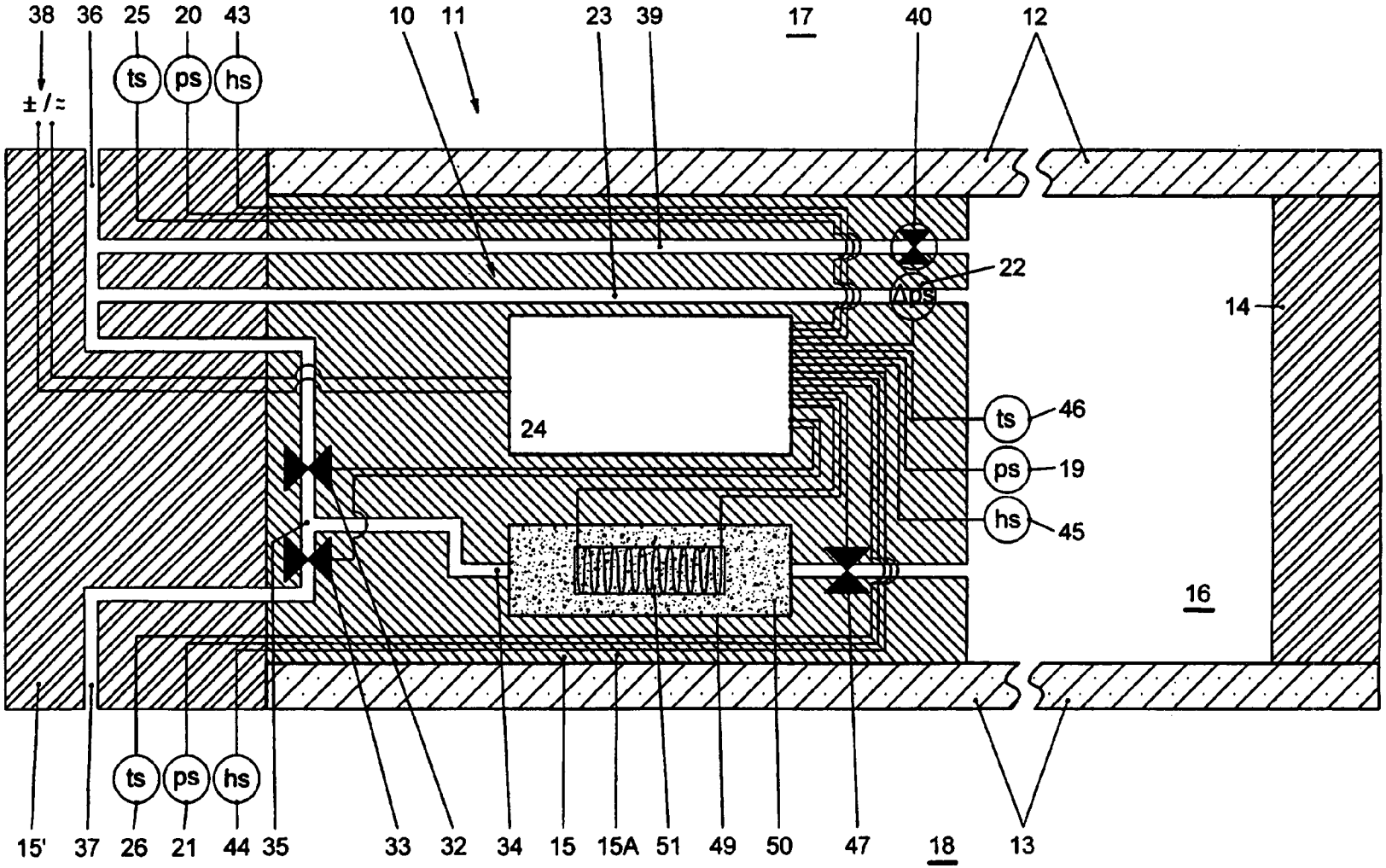
Figure 6:
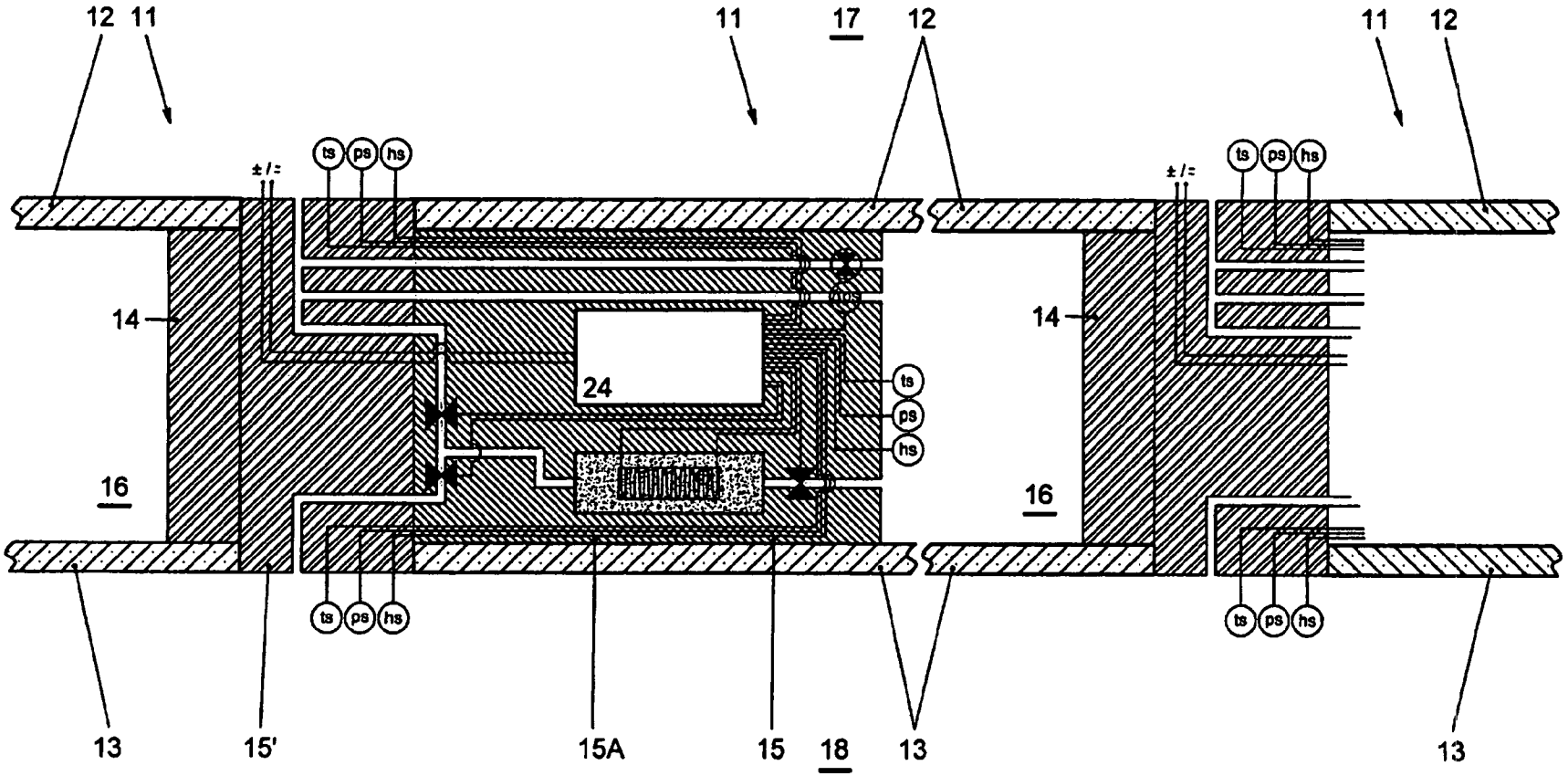
Figure 7:
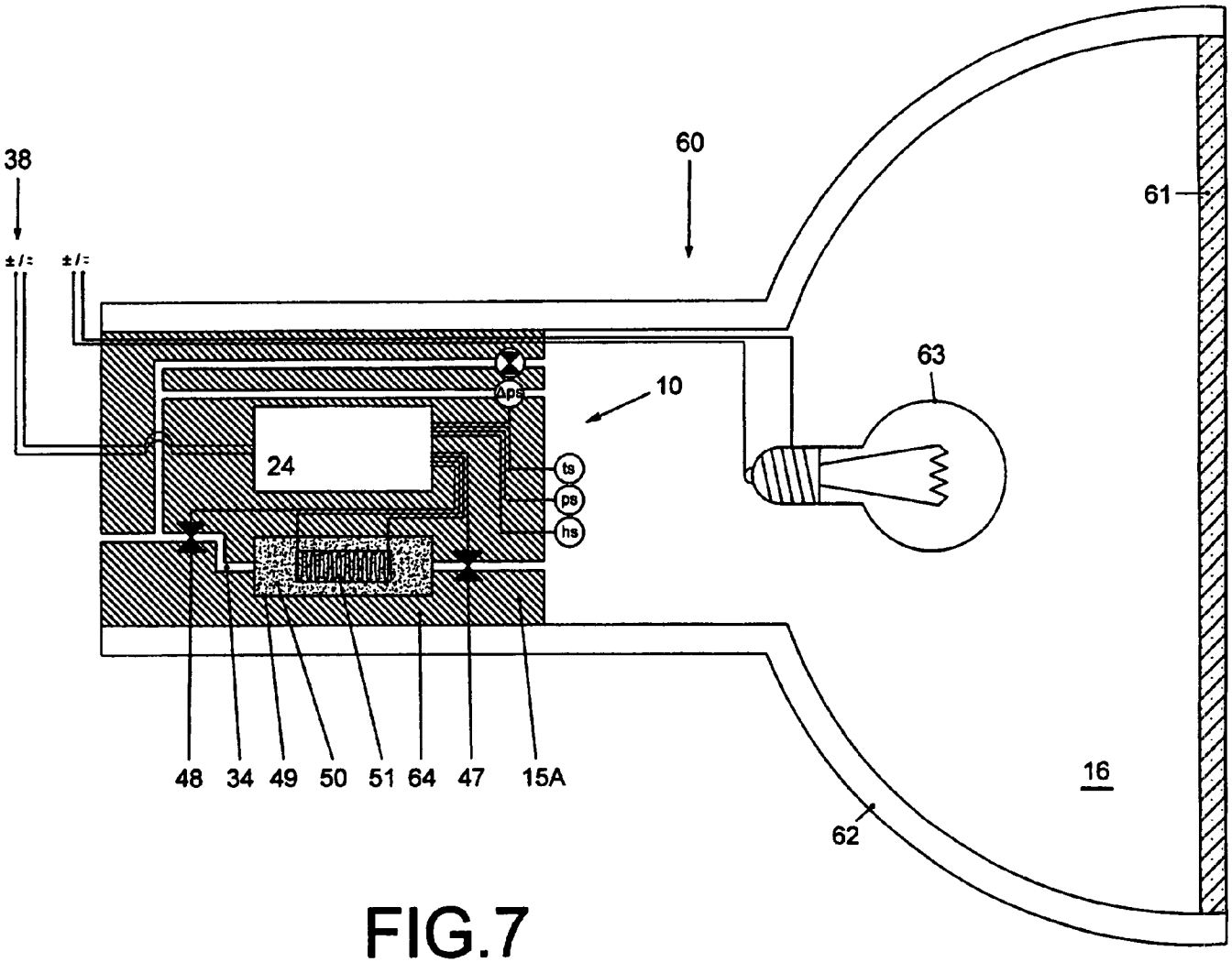

FIG. 6 schematically shows the arrangement of insulating glass assemblies one after the other, e.g. in the case of a facade facing or the like according to FIG. 5; and FIG. 7 shows a lamp with a device according to the invention integrated into the housing base.

Figure 1:
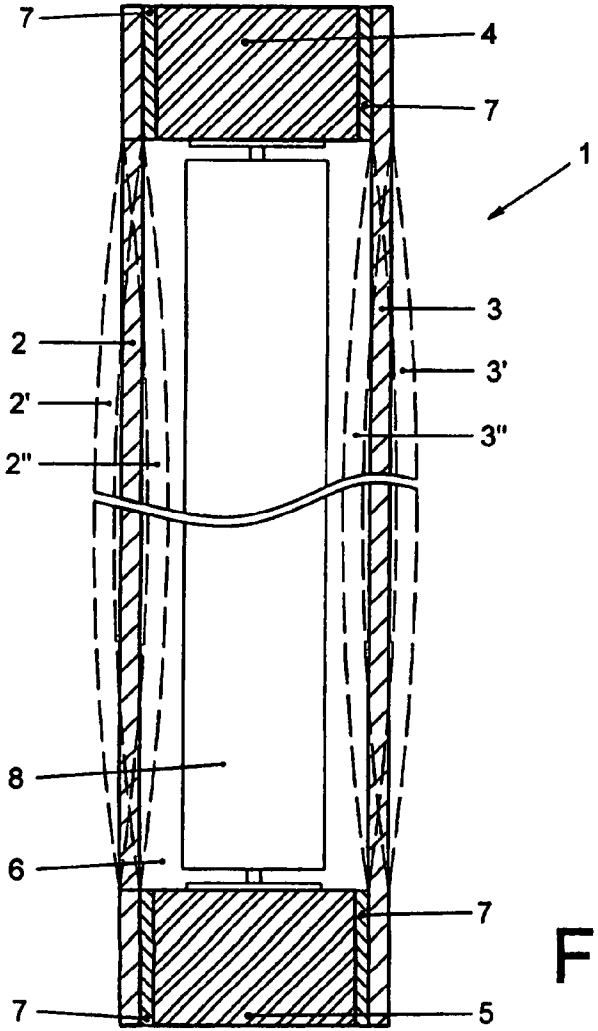

In FIG. 1, an example of a insulating glass assembly of conventional construction, hereinafter referred to as insulating glass 1, is schematically shown in cross-section, wherein two glass panes 2, 3 are connected to each other via spacer ledges 4, 5, thus delimiting a space 6. In the case of conventional insulating glass assemblies 1, this space 6 is filled with air or with another gas, such as neon gas or argon. The glass panes 2, 3 are connected to the spacer ledges 4, 5 via adhesive connections 7. In the (inter)space 6, e.g. sun-screen blades 8 (or light-deflecting elements or roller blinds) can be arranged, and the glass panes 2, 3 can be provided with metal vapor coatings on the inner side (and outer side), which coating is, however, not further illustrated in FIG. 1.

In FIG. 1 the dashed lines also illustrate the glass panes 2, 3 curving outward (cf. deformed glass panes 2', 3') or curving inward (cf. deformed glass panes 2", 3") depending on the pressure difference between the space 6 and the environment. In the case of a low pressure in the space 6 as compared to the environment and of a corresponding inward curving of the glass panes 2, 3, this might lead to the blades 8 getting into contact with the inner surfaces of the glass panes 2, 3, possibly causing damage of the blades 8 or of the optional metal vapor coatings provided on the glass panes 2, 3. Moreover, the adhesive connections 7 are negatively affected by the deformations of the glass panes 2, 3, possibly leading to leakages or even to detachments of the adhesive connections. In doing so, it has to be considered that with large glass panes 2, 3 correspondingly great forces may occur in the region of the adhesive connections 7. Additionally, there may be such a pronounced deformation of the glass panes 2, 3 that also the glass will break.

Figure 2:
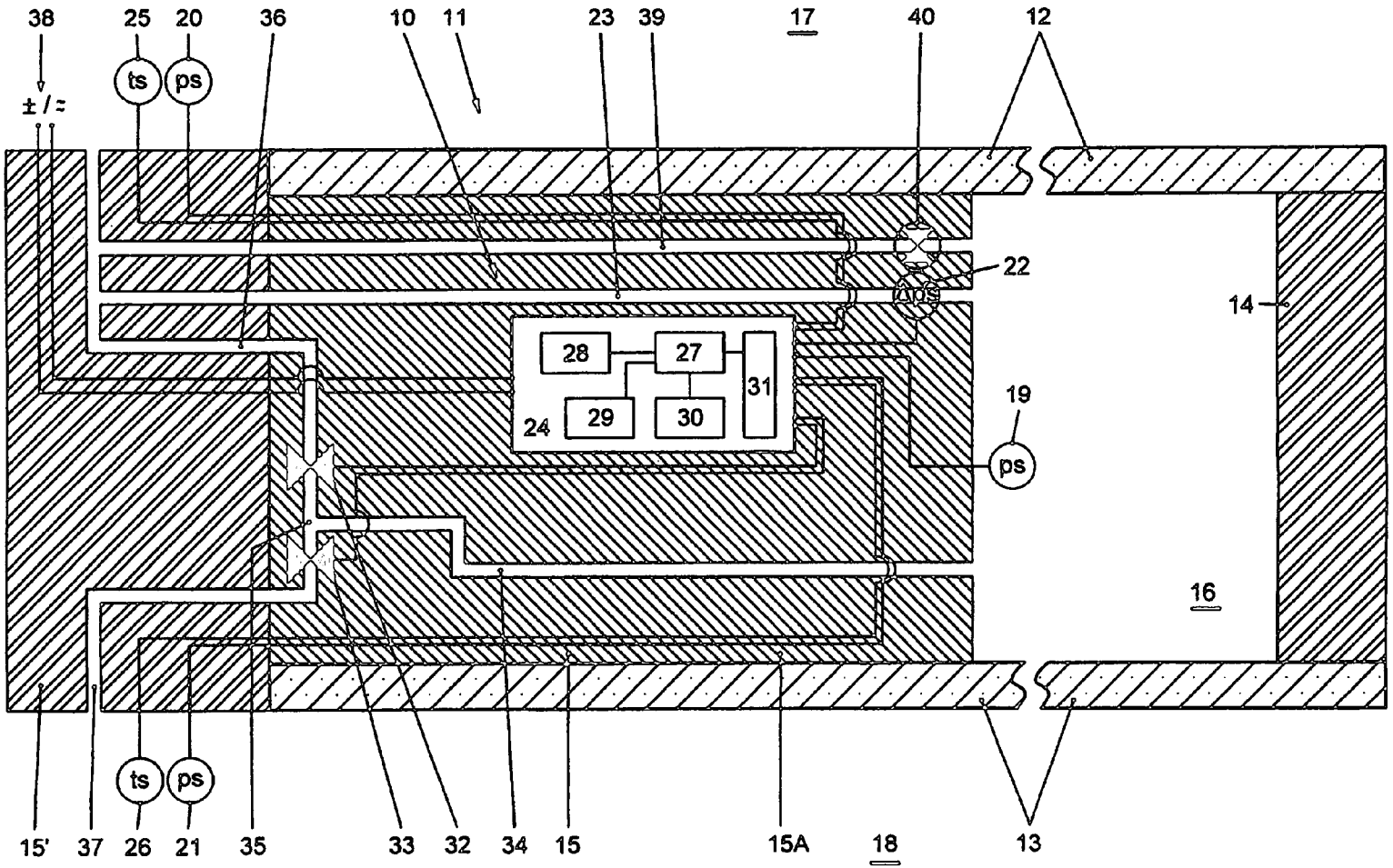
FIG. 2 shows a cross-section through a part of an insulating glass assembly including the device according to the invention.

In FIG. 2 there is shown an insulating glass 11 with a device 10 for controlling the atmosphere in a space between the glass panes 12, 13 of the insulating glass 11, wherein the glass panes 12, 13 again are connected to each other via spacer ledges or connecting ledges 14, 15 provided on the edges, which also form members, e.g. 15A, which laterally delimit the space 16 between the glass panes 12, 13. In this context, again not further illustrated adhesive connections, similar to the adhesive connections 7 of FIG. 1, may be provided but also other connections, such as, e.g. clamp connections or screw connections, with gaskets interposed. Moreover, in FIG. 2 also an edge ledge 15' adjoining a spacer ledge 15 is illustrated, via which the electrical or pneumatic connections further discussed below are realized. The interspace 16 between the glass panes 12, 13 forms the space 16 to be controlled, wherein possible installations, such as sun-screen blades, light-deflecting elements, roller blinds or the like, are not further illustrated in FIG. 2 for the sake of simplicity, although they may be present in the space 16.

The insulating glass 11 separates e.g. an external environment from a room of a building and, accordingly, an exterior side 17 as well an interior side 18 of the insulating glass 11 are shown by way of example. With respect to the space 16, the atmosphere (pressure, moisture) of which is to be controlled, the exterior 17 as well as the interior 18 form the reference "environment". In this case, the pressure on the exterior 17 is usually the same or virtually the same as the pressure on the interior 18, unless specially sealed closed rooms of the building are concerned, wherein then a pressure sensor 19 assigned to the space 16 as well as ambient pressure sensors 20, 21 may be provided for pressure observation. At presumably the same pressure on the exterior 17 as well as on the interior 18, however, one of the pressure sensors 20, 21 may be omitted, such as in particular the pressure sensor 21. Since the detection of the pressure difference between the space 16 and the environment 17/18 is essential, a pressure difference sensor 22 may also be provided in a connecting path (flow path) 23 between the space 16 and the environment, e.g. 17, instead of the separate pressure sensors 19, 20, 21. It is, of course, also possible to provide both the pressure difference sensor 22 and the pressure sensors 19, 20, 21, e.g. for security reasons.

An electric control unit 24 is connected to said pressure sensors 19, 20, 21 and the pressure difference sensor 22, respectively, which unit is, moreover, also connected to an exterior temperature sensor 25 and with an interior temperature sensor 26. The control unit 24 may also comprise a processor component 27 as an essential element, which component is connected to a clock generator 28 functioning as timer as well as additionally to a program memory 29 and a data memory 30. The processor 27 is connected to the mentioned sensors 19, 20, 21, 22, 25, 26 via an interface unit 31, which sensors provide input signals, i.e. parameter signals, for the processor 27, as far as the sensors actually are realized in the respective practical embodiments. Via the interface unit 31, a connection is then provided from the control unit 24 to two electrically actuatable valves 32, 33. Depending on the input parameters, said valves 32, 33 are selectively activated by the control unit 24 for connecting the space 16 with the exterior 17 or also with the interior 18, if necessary. For this purpose a connecting passage 34 is provided, leading from the space 16 to a branching 35, from where branch ducts 36, 37 assigned to the connecting passage 34 lead to the exterior 17 and to the interior 18, respectively. The valve 32 is arranged in the branch duct 36 which leads to the exterior 17, whereas the other valve 33 is provided on the other branch duct 37 which leads to the interior 18.

When a predetermined-low-difference pressure $\Delta p1$ (cf. also FIG. 3) is attained for the pressure difference between the space 16 and the environment 17 and 18, respectively, depending on the temperature detected on the exterior 17 and the interior 18, it is in this manner possible to connect the space 16 either with the exterior 17 or with the interior 18 by opening the valve 32 or valve 33, depending on where the colder air is present, in order to conduct air from the environment, i.e. from the exterior 17 or also from the interior 18 to the space 16. As is generally known, colder air has a lower moisture content so that, thus, the moisture content in the space 16 can be kept low and condensation or corrosion effects can simply be avoided in this manner.

If the pressure in the space 16 is higher compared to the pressure in the environment 17/18, any one of the valves 32, 33 may be opened but also both valves 32 and 33 may be opened in this case until the desired pressure compensation has occurred, whereafter both valves 32, 33 are closed again.

As mentioned, power may be supplied via the edge ledge 15', connecting terminals 38 being schematically shown in FIG. 2.

In a further, separate connecting path 39 between the space 16 and the environment, a mechanical, per se conventional pressure difference valve 40 is arranged, serving as an emergency valve which automatically opens in the case of a malfunction of the control unit 24 and in the case of a high pressure difference $\Delta p2$ between the space 16 and the environment 17/18 (cf. also FIG. 3) and which automatically effects a pressure compensation. In this ease the pressure difference $\Delta p2$ is higher than the pressure difference value $\Delta p1$. The pressure difference valve 40 may be a valve which opens in both directions at a predetermined pressure difference, including one or two closing member(s), which member(s) is/are biased in both directions by spring means for the predetermined pressure. In the example illustrated in FIG. 2, the connecting path 39 opens into the branch duct 36 which leads to the exterior 17. The connecting path 23 also opens into said branch duct 36, the pressure difference sensor 22 being arranged in said path.

Figure 3:
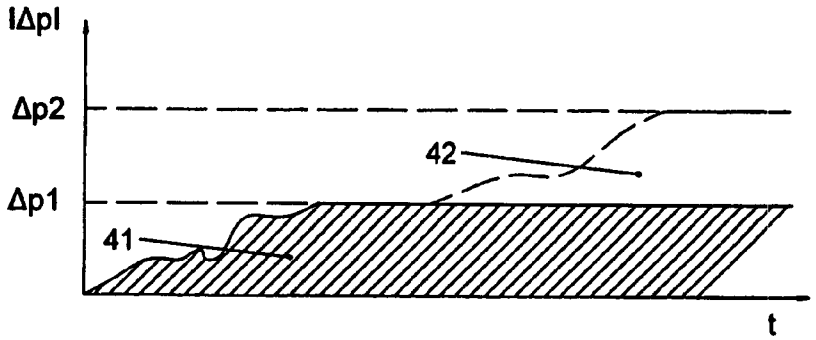
FIG. 3 shows a diagram illustrating the performance of the control obtainable by means of the device according to FIG. 2 with respect to the predetermined pressure difference values.

In FIG. 3 the usual operation range of the device 10 is schematically illustrated below the Δp1-line at 41, and a case of emergency is illustrated with dotted line 42, i.e. an increase of the pressure difference which is higher than Δp1 and which may reach the value Δp2, wherein then the emergency valve 40 opens at this pressure difference value Δp2.

Figure 4:
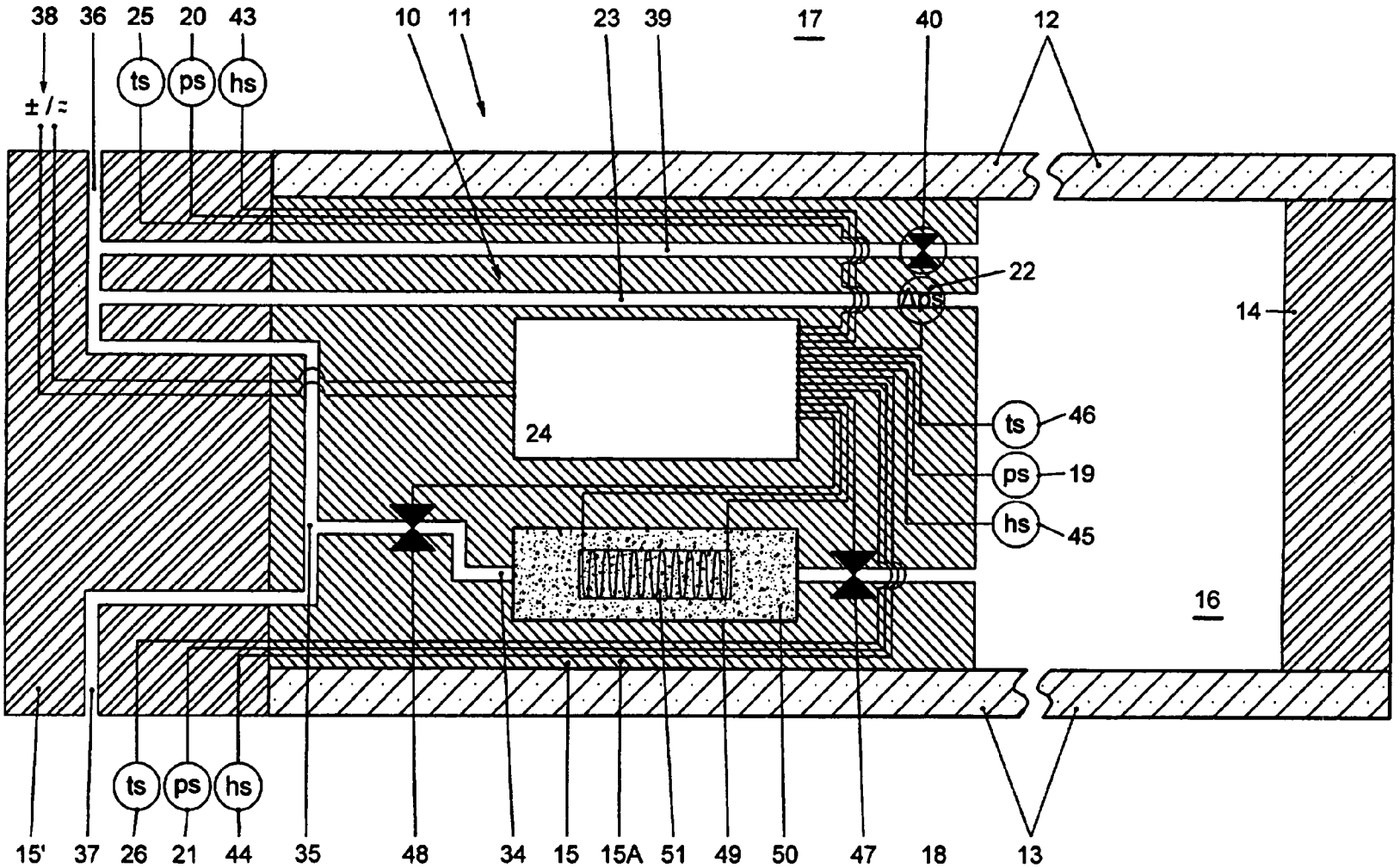
FIGS. 4 and 5 show two further embodiments of the device according to the invention in connection with an insulating glass assembly in cross-sections corresponding to FIG. 2.

In FIG. 4 (and similarly in FIG. 5) there is illustrated a section through an insulating glass 11 comparable to FIG. 2, yet with a somewhat modified device 10. In this example, corresponding components are given the same reference numerals as in FIG. 2. The control unit 24 according to FIG. 4 (and FIG. 5) is structured similarly as in FIG. 2 so that a more detailed illustration thereof has been omitted in FIGS. 4 and 5. For the sake of simplicity and to avoid repetitions, the embodiments according to FIGS. 4 and 5 shall be explained just by basically accentuating the differences to FIG. 2. (and to FIG. 4, respectively); if the same embodiment is illustrated therein, reference is made to the above description of FIG. 2.

According to FIG. 4, ambient moisture sensors 43, 44 as well as a space moisture sensor 45 and, furthermore, a space temperature sensor 46 is/are provided additionally to the sensors 19 to 22, 25 and 26 already described by way of FIG. 2. Instead of valves 32 and 33 provided in the branch ducts 36, 37 according to FIG. 2, now valves 47, 48 are arranged in the connecting passage 34 on either side of an area 49 with a drying agent 50 (silica gel), wherein, moreover, a heating means 51, e.g. including an electrical resistance heating, is assigned to the drying-agent area 49, namely to the drying agent 50 provided therein, which heating means likewise is activated by the control unit 24 in order to heat the drying agent, said activation occurring at either fixedly predetermined intervals or at intervals depending on the respective moisture values detected by the sensors 43 to 45.

During normal operation the valve 47 provided between the drying-agent area 49 and the space 16 is opened according to the embodiment of FIG. 4, so that the drying agent 50 can absorb and bind moisture from the space 16. The valve 48 arranged between the drying agent 50 and the environment 17, 18 basically could also be omitted, yet it is suitable to provide said valve 48 and to keep it closed during normal operation by means of the control unit 24, since then only the moisture from the space 16 is bound by the drying agent 50. When the drying agent 50 is more or less saturated with moisture (this can be estimated on the basis of experience and by way of moisture parameters detected), the control unit 24 activates the heating means 51 for heating the drying agent 50 and for thereby converting the water absorbed therein into vapor, the latter being led to the environment 17/18. For this purpose, the valve 48 is opened towards the environment, whereas the valve 47 is closed towards the space 16. In the vapor state, water has roughly the thousandfold volume of its volume in the bound or liquid state, and the released vapors escape directly into the environment 17/18.

After the heating step, the drying agent 50 has to cool down again to be capable of absorbing new moisture from the space 16. In order to accelerate said cooling, a Peltier element may advantageously be provided as heating element or heating means 51, respectively, instead of a resistance heating wire, since a Peltier element allows for both heating and cooling, depending on how it is activated.

The pressure difference sensor 22 or the pressure sensors 19, 20 and 21, in turn, serve for detecting the pressure difference between the space 16 and the environment 17/18 and for thus improving the mode of operation of the device 10: at very little pressure differences the system may remain closed for avoiding an unnecessary saturation of the drying agent 50. Moreover, the step of drying, i.e. the heating of the drying agent 50, may then also be started when there is an overpressure in the space 16 so that the drying agent 50 can be aerated from the space 16 to the environment 17 and 18, respectively, after the release of the bound water molecules to the environment 17 and 18, respectively, by shortly opening both valves 47, 48; this may also be realized by the aid of the control unit 24.

During the cooling phase of the drying agent 50, the valve 47 is preferably kept closed to interrupt the gas/air exchange with the environment 17/18, and the valve 47 is opened only when the drying agent 50—after cooling down—can absorb moisture again.

It is also advantageous to provide the device 10 with two, three or more drying-agent areas 49, with separate heating means 51, in parallel circuits, so that always at least one drying-agent area 49 is ready for absorbing moisture from the space 16 and that, furthermore, the inner pressure may continuously be compensated with the ambient pressure without any interruptions; in other words, the system then can absorb gas or air, respectively, from the outside at any time, since at least one drying-agent area 49 is cold and thus active at any time.

For the sake of completeness it is to be mentioned that, in principle, the temperature sensors 25, 26 and 46 as well as the moisture sensors 43, 44, 45 as illustrated in the embodiment of FIG. 4 can also be omitted, wherein then the control unit 24 activates the valves 47, 48 or the heating means 51, respectively, at fixedly predetermined times or depending on the pressures, respectively.

With the aid of the control unit 24, the output signals of the moisture sensors 43 to 45 may be used for drawing conclusions regarding the moisture content in the individual spaces, and, accordingly, the drying agent 50 may be heated at shorter or longer intervals to release water vapor into the environment.

Besides, again, an emergency valve 40 is also present with the embodiment illustrated in FIG. 4 to keep the pressure difference between the space 16 and the environment 17 or 18, respectively, within the preset limits (Δp2 according to FIG. 3) in the case of, e.g., a power outage or a control malfunction, in order to prevent the glass panel 11 from being destructed.

The embodiment according to FIG. 5 can be seen as a combination of the embodiments of FIGS. 2 and 4, wherein the valve 48 of FIG. 4 is replaced by the two valves 32, 33 of FIG. 2 to allow for gas or air, respectively, to be selectively conveyed into the space 16 via the branch ducts 36 from the exterior 17 or also via the branch ducts 37 from the interior 18. Also via the temperature moisture sensors 25, 26, 46 or 43, 44 and 45, respectively, according to a further development of the operational algorithms it may be detected from which side (outer side 17 or inner side 18) a medium, i.e. air, that is medium having the lower water vapor content, shall be conveyed to the space 16. The individual pressure sensors 19, 20 and 21 enable the pressure in the space 16 to be adjusted to the respective higher ambient pressure (exterior 17 or interior 18), if there is a pressure difference between the two sides 17 or 18, respectively.

In all embodiments, the device 10, i.e. the control unit 24, the valves 32, 33 provided in the connecting passage 34, the drying-agent area 49 and the heating means 51, is directly incorporated into the member 15A delimiting the space 16, i.e. into the spacer ledge (into the spacer 15), wherein connections may be used for supplying the control unit 24 and, optionally, the heating means 51 with power, which connections are provided for supplying adjustment devices of sunscreen blades or the like in the space 16 with power.

The different sensors provided outside can be arranged directly on the frame of the window or on the frame of the glass panel 11, e.g. on the frame ledge 15'. In the case of insulating glass assemblies for windows, the device 10, however, may also be incorporated into a frame of a window, into a casement frame etc. (as part delimiting the space 16).

In FIG. 6 it is schematically shown that insulating glass assemblies 11 with the described device 10, as, e.g., according to FIG. 5, may be arranged in a row directly Front-face to front-face, if used for a facade. Thus, the glass panels 11 together with the inventive devices 10 form separate component units which are correspondingly used and installed. Especially here, the edge ledges 15' may also be replaced or formed, respectively, by gaskets or silicone junctures.

In FIG. 7 another application of the inventive device 10 is illustrated, namely for a lamp which is exposed to moisture, such as an outdoor lamp, i.e. for a lamp to be installed outdoors which is exposed to the outdoor conditions (e.g. lamps installed on buildings, in stadia, tunnelings, streets, and facade projectors); for an indoor lamp which is exposed to moisture, such as, e.g. a moisture-proof lamp, bottom built-in illuminators; or for a lamp used with vehicles. According to FIG. 7 the lamp 60 includes a glass cover 61 as glass component in a housing 62 in which a light source 63, such as, e.g. an incandescent lamp, is provided; furthermore, a socket 64 is assigned to the housing 62 as further member 15A delimiting the space 16, wherein the space 16 which is to be controlled in terms of its atmosphere (pressure, moisture) is defined by the components 61, 62 and 64. In this respect, the device 10 may basically correspond to the device according to FIG. 4 so that it is not necessary to describe the same once again. In the embodiment according to FIG. 7, however, the branching with the branch ducts in the connecting passage may be omitted, since here no exterior and no interior of the building is present. Also in the embodiment according to FIG. 7 a drying agent 50 may be used for moisture absorption. Theoretically, the heating of the drying agent 50 could also be realized by the aid of the light source 63, this may, however, lead to problems when the lamp 60 has not been turned on for a longer time or when the lamp 60 is turned on the whole night, so that nevertheless a separate heating means 51 is preferably provided for the drying agent 50 in the drying-agent area 49.

Here it is also conceivable to temporally couple the regeneration of the drying agent 50 (by activating the heating means 51) with turning on the lamp 60.

In the case of insulating glass assemblies 11 with the inventive device 10, elements, such as sun-screen blades (8 in FIG. 1) or light-deflecting elements, are optionally arranged in the space 16.

What is claimed is:

1. A device for controlling the atmosphere in a space which is partly delimited by at least one glass component and which is separated from the environment, said device comprising:

a member partly delimiting the space, and including a connecting passage providing at least one connection between the space and the environment; and at least one electronically actuable valve which is connected to an electric control unit for its automatic actuation, wherein the at least one electrically actuatable valve is arranged in the connecting passage within the member, and wherein the electric control unit is arranged within said member.

2. The device according to claim 1, wherein the control unit includes a timer for opening, or closing, respectively, the at least one electrically actuatable valve at predetermined times.

3. The device according to claim 1, wherein the control unit is connected to at least one sensor outputting a sensor signal and is selected from the group consisting of a pressure sensor, pressure difference sensor, temperature sensor and moisture sensor, for actuating the at least one electrically actuatable valve in dependence on the sensor signal.

4. The device according to claim 3, wherein the control unit is connected to a pressure difference sensor which is arranged to detect the pressure difference between the space and the environment.

5. The device according to claim 3, wherein the control unit is connected to a pressure sensor which is arranged to detect the pressure in the space as well as to a further pressure sensor which is arranged to detect the pressure of the environment.

6. The device according to claim 3, wherein the control unit is connected to at least one temperature sensor which is arranged to detect the ambient temperature of the environment.

7. The device according to claim 3, wherein the control unit is connected to a moisture sensor associated to the space.

8. The device according to claim 7, wherein the control unit is connected to a moisture sensor detecting the moisture of the environment.

9. The device according to claim 8, wherein the space to be controlled is the interspace between an outer glass pane and an inner glass pane of an insulating glass assembly, and wherein the control unit is connected to an outer environment moisture sensor and an inner ambient moisture sensor.

10. The device according to claim 1, wherein a pressure difference valve is arranged as an emergency valve in the member delimiting the space in a separate connecting path between the space to be controlled and the environment.

11. The device according to claim 1, wherein the member is a connecting ledge arranged between two glass panes of an insulating glass assembly.

12. The device according to claim 11, wherein the two glass panes comprise an outer glass pane and an inner glass pane, and wherein the control unit is connected to an outer temperature sensor and an inner temperature sensor.

13. The device according to claim 11, wherein sun-screen elements are arranged between the glass panes.

14. The device according to claim 11, wherein the connecting passage comprises a branching to which branch ducts leading to the outer side and the inner side of the insulating glass assembly are connected, and wherein a respective electrically actuatable valve connected to the control unit is arranged in each branch duct.

15. The device according to claim 14, further comprising a drying agent area in the connecting passage.

16. The device according to claim 15, further comprising an electrical heating means associated with the drying-agent area, said heating means being connected to the control unit.

17. The device according to claim 16, wherein said heating means comprises a Peltier element.

18. The device according to claim 15, further comprising an electrically actuatable valve on each side of the drying-agent area, and being connected to the control unit.

19. The device according to claim 1, wherein the member is a socket of a lamp.

20. The device according to claim 19, wherein the space to be controlled is a space of the lamp receiving a light source and being arranged behind a glass cover.

* * * * *